US009016013B2

(12) United States Patent
Stahl, Jr. et al.

(10) Patent No.: US 9,016,013 B2
(45) Date of Patent: Apr. 28, 2015

(54) CURTAIN WALL ANCHOR FIRE PROTECTION APPARATUS

(71) Applicant: Specified Technologies Inc., Somerville, NJ (US)

(72) Inventors: James P. Stahl, Jr., Princeton Junction, NJ (US); James P. Stahl, Sr., Stockton, NJ (US); David Augello, Hazlet, NJ (US); Paul Gandolfo, Doylestown, PA (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

(21) Appl. No.: 13/998,123

(22) Filed: Oct. 3, 2013

(65) Prior Publication Data

US 2014/0137494 A1 May 22, 2014

Related U.S. Application Data

(60) Provisional application No. 61/796,858, filed on Nov. 20, 2012.

(51) Int. Cl.
*E04B 1/94* (2006.01)
*E04B 2/88* (2006.01)

(52) U.S. Cl.
CPC .. *E04B 1/941* (2013.01); *E04B 2/88* (2013.01)

(58) Field of Classification Search
CPC ..... E04B 1/941; E04B 2/88; E04B 2/96; E04B 2/90; E04B 2/967
USPC ..... 52/1, 232, 235, 743.1
See application file for complete search history.

(56) References Cited

U.S. PATENT DOCUMENTS

| | | | | |
|---|---|---|---|---|
| 3,936,986 | A | | 2/1976 | Steel |
| 3,968,608 | A | | 7/1976 | Swango |
| 4,473,984 | A | | 10/1984 | Lopez |
| 4,899,508 | A | | 2/1990 | Biebuyck |
| 4,905,444 | A | | 3/1990 | Semann et al. |
| 4,951,438 | A | | 8/1990 | Thoresen |
| 5,067,292 | A | | 11/1991 | Finean |
| 5,118,060 | A | | 6/1992 | Spronken |
| 5,406,765 | A | | 4/1995 | Brown |
| 5,454,200 | A | | 10/1995 | Hohmann |
| 5,548,939 | A | | 8/1996 | Carmical |
| 5,765,332 | A | | 6/1998 | Landin et al. |
| 6,105,334 | A | * | 8/2000 | Monson et al. ..... 52/741.3 |
| 6,128,874 | A | * | 10/2000 | Olson et al. ..... 52/232 |
| 6,158,182 | A | | 12/2000 | Biebuyck |
| 6,442,311 | B1 | | 8/2002 | Barbarossa et al. |
| 6,598,359 | B1 | | 7/2003 | Wulfert et al. |

(Continued)

*Primary Examiner* — Brian Glessner
*Assistant Examiner* — Adam Barlow
(74) *Attorney, Agent, or Firm* — Glenn M. Massina, Esq.; Fox Rothschild LLP

(57) ABSTRACT

An apparatus for providing fire protection of curtain wall anchors mounted on the undersides of the building floors including a fire protective housing surrounding the anchor and attached to the floor for enhancing protection from exposure to fire as well as flames and heat. The apparatus can include a housing defining a containment chamber with a upper opening formed of molded mineral wool with an intumescent paper insert positioned therewithin, and a wire frame backing and a molded plastic cover extending therearound. The apparatus is attachable to a floor underside with the protective chamber thereof surrounding a curtain wall anchor assembly attached to the floor underside for fire protection thereof.

26 Claims, 3 Drawing Sheets

(56) References Cited

U.S. PATENT DOCUMENTS

| | | | | |
|---|---|---|---|---|
| 6,598,361 | B2 | 7/2003 | Ting | |
| 6,658,804 | B2 | 12/2003 | Leytes et al. | |
| 6,729,080 | B1 | 5/2004 | Zambelli et al. | |
| 6,804,920 | B2 | 10/2004 | Hogan | |
| 7,017,318 | B1 | 3/2006 | Hohmann et al. | |
| 7,562,506 | B2 | 7/2009 | Hohmann, Jr. | |
| 7,681,366 | B2 | 3/2010 | De Gobbi | |
| 7,886,491 | B1 * | 2/2011 | Shriver | 52/235 |
| 7,941,982 | B2 | 5/2011 | Merica | |
| 8,201,374 | B2 | 6/2012 | Hohmann, Jr. | |
| 8,567,141 | B2 * | 10/2013 | Logan | 52/235 |
| 2002/0148178 | A1 | 10/2002 | Farag | |
| 2003/0033764 | A1 | 2/2003 | Ting | |
| 2003/0033765 | A1 * | 2/2003 | Ting | 52/235 |
| 2003/0150179 | A1 * | 8/2003 | Moreno | 52/235 |
| 2004/0079038 | A1 * | 4/2004 | Crooker, Jr. | 52/235 |
| 2004/0154951 | A1 | 8/2004 | Hartung | |
| 2007/0039258 | A1 | 2/2007 | Walker, III | |
| 2007/0175649 | A1 * | 8/2007 | Moselle | 174/50 |
| 2007/0261343 | A1 | 11/2007 | Stahl, Sr. et al. | |
| 2009/0229208 | A1 * | 9/2009 | Spannbauer | 52/393 |
| 2009/0255619 | A1 | 10/2009 | Tong | |
| 2011/0192110 | A1 | 8/2011 | Grunewald et al. | |
| 2012/0207961 | A1 * | 8/2012 | Drexl et al. | 428/64.1 |

* cited by examiner

CURTAIN WALL ANCHOR FIRE PROTECTION APPARATUS

The present utility application hereby formally claims filing priority of currently U.S. Provisional Patent application No. 61/796,858 filed 20 Nov. 2012 on "CURTAIN WALL ANCHOR FIRE PROTECTION APPARATUS MOUNTED ON FLOOR UNDERSIDE" filed by the same applicant listed herein, namely, Specified Technologies Inc. Said referenced provisional application is hereby formally incorporated by reference as an integral part of the present application.

FIELD OF THE INVENTION

It is common for curtain walls which provide the external facade and surrounding structure for many different types of commercial buildings to be mounted utilizing curtain wall anchors which are dead-load anchors positioned mounted on the underside of the individual floors of the building and extending downwardly therefrom. Most commercial buildings are constructed with concrete floors the construction of the present invention is usable with any floor material.

These curtain wall anchors usually include multiple individual components which are made of aluminum or other relatively low melting point metal materials. Most aluminum components will melt or otherwise fail at fairly low temperatures, when compared to other metals, which is normally around 1200-1300 degrees Fahrenheit and will initially weaken at substantially at 400-500 degrees Fahrenheit. As such, it is preferable that a means be provided for thermally protecting these curtain wall anchors from exposure to fire, flames and heat to prevent structural failure in the mounting system for the curtain wall spandrel panels, mandrels and other components of the integral construction of such curtain walls when exposed to heat and fire conditions. Curtain wall anchors are the primary means for support of the external building façade and, as such, structural failure must be avoided.

The anchors for mounting brackets located beneath the floors need to be protected to prevent any catastrophic failure when exposed to fire and heat conditions in such a manner as to provide conventional hourly fire-resistant protection. Fire insulation materials are currently commonly positioned between the edge of the floor and the vertically extending curtain wall panels and this insulation normally comprises some type of a mineral wool batt or safing positioned in this area.

DESCRIPTION OF THE PRIOR ART

Many different designs are currently used in the prior art for curtain wall panel constructions and mountings such as shown in U.S. Pat. No. 3,968,608 patented Jul. 13, 1976 to B. Swango on a "Curtain Wall Panel Support"; and U.S. Pat. No. 4,473,984 patented Oct. 2, 1984 to D. Lopez on a "Curtain-Wall Masonry-Veneer Anchor System"; and U.S. Pat. No. 5,454,200 patented Oct. 3, 1995 to R. P. Hohmann on a "Veneer Anchoring System"; and U.S. Pat. No. 6,158,182 patented Dec. 12, 2000 to L. F. Biebuyck and assigned to Butler Manufacturing Co. on a "Building Curtain Wall"; and U.S. Pat. No. 6,442,311 patented Aug. 27, 2002 to G. Barbarossa et al and assigned to Agere Systems Guardian Corp. on an "Optical Device Having Modified Transmission Characteristics By Localized Thermal Treatment"; and U.S. Publication No. 2003/0033764 published Feb. 20, 2003 to R. M. Ting on a "Mullion Splice Joint Design; and U.S. Pat. No. 6,598,359 patented Jul. 29, 2003 to H. Wulfert et al on an "Earthquake-Immune Curtain Wall System"; and U.S. Publication No. 2004/0079038 published Apr. 29, 2004 to R. H. Crooker Jr. on a "Curtain Wall Anchor"; and U.S. Pat. No. 6,804,920 patented Oct. 19, 2004 to J. C. Hogan and assigned to X-Clad, Inc. to "Tube-Lock Curtain Wall System"; and U.S. Publication No. 2007/0039258 published Feb. 22, 2007 to J. R. Walker III on an "Adjustable Attachment System; and U.S. Pat. No. 7,017,318 patented R. P. Hohmann et al and assigned to Hohmann & Barnard, Inc. on a "High Span Anchoring System For Cavity Walls"; and U.S. Pat. No. 7,562,506 patented Jul. 21, 2009 to R. P. Hohmann, Jr. and assigned to MiTek Holdings, Inc. for "Notched Surface-Mounted Anchors And Wall Anchor Systems Using The Same"; and U.S. Pat. No. 7,941,982 patented May 17, 2011 to A. E. Merica on an "Integrated Curtain Wall And Wireway Distribution System"; and U.S. Publication No. 2011/01922110 published Aug. 11, 2011 to F. A. Grunewald et al on a "Curtain Wall External Support System"; and U.S. Pat. No. 8,201,374 patented Jun. 19, 2012 to R. P. Hohmann, Jr. and assigned to MiTek Holdings, Inc. on a "Wind Load Anchors And High-Wind Anchoring Systems For Cavity Walls".

SUMMARY OF THE INVENTION

The present invention provides a curtain wall anchor fire protection apparatus used for protecting curtain wall anchors which are commonly attached to the underside of a concrete floor construction in commercial and other buildings and extend downwardly therefrom. The fire protection apparatus of the present invention includes a housing of fire protective material such as molded mineral wool which defines a protective chamber means and an upper opening. The upper opening provides a path for positioning of the housing in contact with a floor undersurface thereabove such that the curtain wall anchor will extend through the upper opening into the protective chamber for surrounding thereof and achieving fire protection.

Additional fire protection is provided by an intumescent liner which may be positioned within the protective chamber between the housing and the curtain wall anchor for enhancing fire protection thereof due to the intumescent characteristics thereof. A backing frame member which is preferably of an open wire configuration is attachable extending around the housing for facilitating retaining thereof with respect to the floor undersurface. An outer cover may be attachable surrounding the outward portion of the open wire backing frame member for aesthetic purposes. Securement of this apparatus with respect to the undersurface of the floor is enhanced by the inclusion of flange portions on the outer cover and the backing frame member and the intumescent liner as well as on the housing itself. Fasteners can be provided which can be driven upwardly to simultaneously drive through each of these four flanges and be further driven into engagement into the undersurface of the floor thereabove for installing all components of the fire protection apparatus of the present invention simultaneously in position attached to the floor undersurface with the curtain wall anchor extending into the protection chamber means therebelow by extending through the upper opening.

It is an object of the curtain wall anchor fire protection apparatus which is mounted on the underside of the floors of buildings to provide fire protection for curtain wall anchors which are commonly include components or parts made primarily of aluminum which is particularly susceptible to fire damage at lower temperatures than most other metals.

It is an object of the curtain wall anchor fire protection apparatus which is mounted on the underside of the floors of buildings to provide a housing with a protective chamber defined therein and an upwardly facing opening defined therewithin facilitate complete protection by surrounding curtain wall anchors to enhance fire protection thereof.

It is an object of the curtain wall anchor fire protection apparatus which is mounted on the underside of the floors of buildings to provide a housing made of fire resistant material such as ceramic, fiber or calcium silicate magnesium to provide for fire protection of curtain wall anchors from all directions.

It is an object of the curtain wall anchor fire protection apparatus which is mounted on the underside of the floors of buildings to provide enhanced fire protection of conventional factory-assembled curtain wall mounting anchor assemblies.

It is an object of the curtain wall anchor fire protection apparatus which is mounted on the underside of the floors of buildings to provide a means for preventing catastrophic failure of the support structure for curtain wall spandrel panels and the overall curtain wall structures when exposed to conditions of heat and/or fire.

It is an object of the curtain wall anchor fire protection apparatus which is mounted on the underside of the floors of buildings to provide a protective housing formed of fire protective material which can include paper intumescent liners within the protective chamber means of the fire protective housing to enhance fire protection of a curtain wall mounting anchors components positioned within the protective chamber means of the fire protective housing.

It is an object of the curtain wall anchor fire protection apparatus which is mounted on the underside of the floors of buildings to provide protection from direct fire, heat and flame exposure for aluminum curtain wall anchors mounted on floor undersurfaces.

It is an object of the curtain wall anchor fire protection apparatus of the prevent invention to facilitate fire protection of curtain wall brackets and other supports mounted on the underside of concrete floors which have minimal maintenance requirements.

It is an object of the curtain wall anchor fire protection apparatus which is mounted on the underside of the floors of buildings to provide fire protection which is of minimal total cost considering parts as well as labor required for assembly and installation.

DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
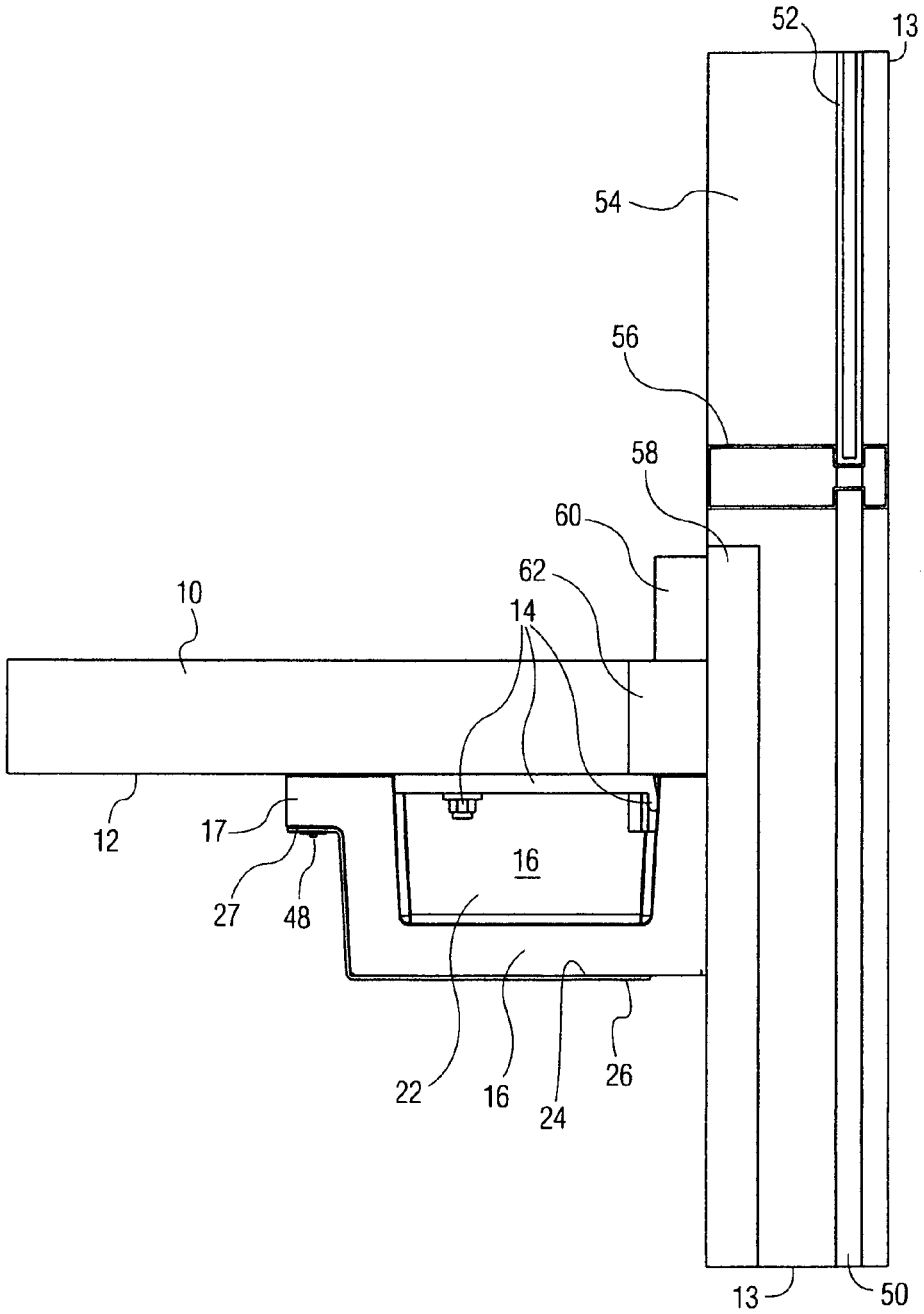
FIG. 1 is a cross-sectional side view showing an embodiment of the curtain wall anchor fire protection apparatus of the present invention mounted on the underside of a building floor extending around a curtain wall anchor construction mounted thereto and extending downwardly therefrom and also illustrates surrounding curtain wall construction supported thereby.
Figure 2:
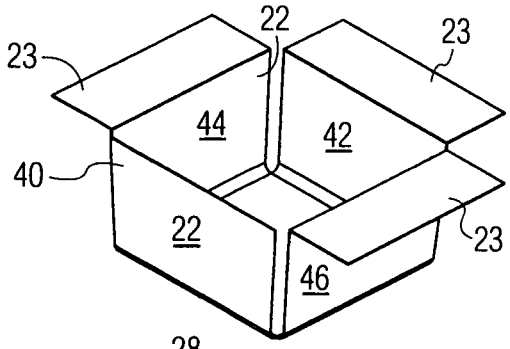
FIG. 2 is a top perspective view of an embodiment of the intumescent liner of the present invention.

The present invention provides a curtain wall anchor fire protection apparatus designed to be mounted on the underside 12 of a floor construction 10 which is usually but not always formed of concrete. The underside 12 facing downwardly therefrom is commonly the location where the curtain wall dead-load anchors 14 or brackets are normally mounted. These curtain wall anchors are usually made of aluminum material which tends to initiate melting between 1200 and 1300 degrees Fahrenheit and to structurally weaken between 400 and 500 degrees Fahrenheit. It is especially important that these curtain wall anchors or mounting brackets 14 be protected from fire, flame and heat to prevent catastrophic failure of the supporting construction for the curtain wall 13 which is held in place by the structural integrity of such anchors or brackets 14. The curtain wall 13 includes various horizontal and vertically extending components and includes an external facade extending vertically as well as all supporting structure. Failure of the structural integrity of the curtain wall anchors 14 would result in catastrophic failure of the entire curtain wall assembly 13 which can occur responsive to the high temperatures conditions of exposure thereof to fire.

The present invention provides an assembly designed specifically to provide protection from direct fire and heat exposure for the curtain wall anchors or brackets 14. The design of the assembly of the apparatus of the present invention includes a protective housing which can be made of any high temperature formable material which is preferably vacuum-formed from ceramic fiber or from readily available conventional materials used for this purpose such as calcium silicate magnesium.

The curtain wall anchor fire protection apparatus of the present invention will include a housing 16 which defines a protective chamber means 18 therewithin having an upper opening 20. Upper opening 20 is in full fluid flow communication with respect to the interior portion of protective chamber 18. Upper opening 20 faces upwardly toward the floor underside 12. Housing 16 is positionable to be attached with respect to a floor underside 12 of a floor construction 10 with the protective chamber means 18 completely surrounding a curtain wall anchor bracket 14 when positioned secured to the underside 12 of floor construction 10 and extending downwardly therefrom.

When the housing 16 is secured with respect to the floor underside 12 the curtain wall anchor or bracket 14 will extend downwardly through the upper opening 20 into the protective chamber means 18 to facilitate fire protection thereof. To facilitate securement of housing 16 with respect to the floor underside 12 a housing flange 17 will preferably be included in the structure of the housing. Preferably housing flange 17 will extend outwardly therefrom laterally to provide an enhanced securement surface for engagement with respect to the floor underside 12. Preferably housing flange 17 will extend completely around the upper opening circumferentially in order to form a seal with respect to the floor underside 12 thereabove to enhance protection of the curtain wall anchor from exposure to fire conditions. A plurality of fasteners 48 can be provided which will extend through the housing flange and into the floor 10 for attachment with respect thereto. To facilitate such securement the housing flange will preferably define one or more housing flange securement apertures 28 within the housing flange 17. In this manner conventional threaded fasteners 48, such as screws or the like, can extend upwardly through the housing flange securement apertures 28 and, thusly, through the housing flange 17 and extend into the floor underside 12 to be fixedly secured with respect to the floor construction 10. Preferably, the protective chamber 18 will be of generally rectangular or square cross-section and will include a first inner wall 30 and a second inner wall 32 spaced apart from one another and extending generally parallel to one another. A third inner wall 34 and a fourth inner wall 38 will also be included spatially disposed from each other in positions extending parallel with respect to one another and both walls 34 and 38 will be perpendicularly oriented with respect to the first inner wall 30 and the second inner wall 32. Chamber floor 36 will be positioned below the each of the inner walls 30, 32, 34 and 38 and will be positioned oriented approximately perpendicular with respect thereto and therebelow. In this manner the four inner walls 30, 32, 34 and 38 and the chamber floor 36 will define the outer boundaries of the protective chamber 18. As such, the chamber floor 36 and the walls 30, 32, 34 and 38 will, preferably, define the generally rectangular or square cross-sectional shape of the protective chamber 18.

Figure 3:
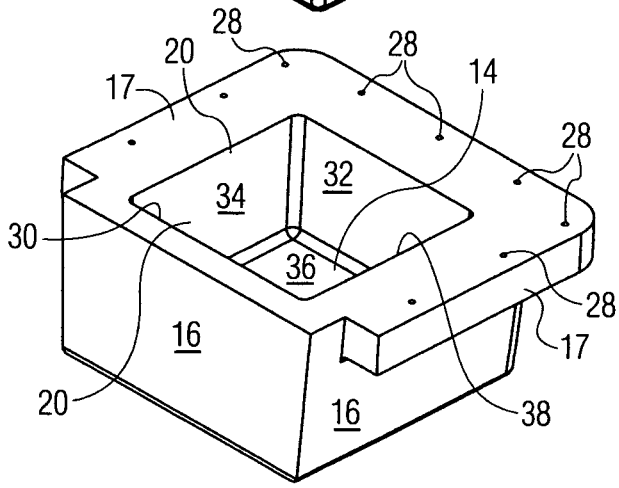
FIG. 3 is a top perspective view of an embodiment of a construction of a molded housing of the present invention.
Figure 4:
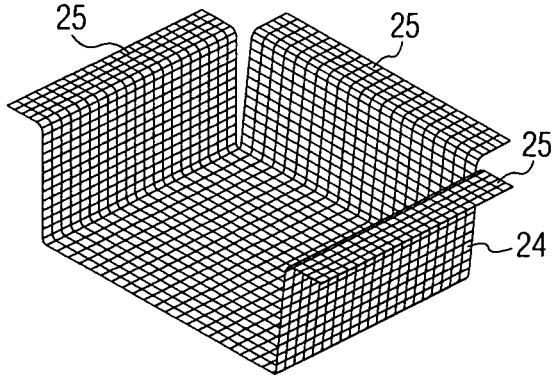
FIG. 4 is a top perspective view of an embodiment of an open wire backing frame member of the present invention.

In this preferred configuration or best mode of the present invention the housing 16 will be formed of a fire protective material and preferably will be formed of a molded mineral wool material. Mineral wool material is available in the marketplace which can be molded into various shapes and the forming of the housing 16 out of such moldable mineral wool material into the shape shown in FIG. 3 is an important aspect of the present invention due to ease of manufacture and excellent firestopping characteristics. While mineral wool material is the preferred material from which the housing 16 is formed, it should be appreciated that housing 16 can also be formed of other materials such as calcium silicate magnesium or other similar fire protective materials.

In order to further enhance the fire protection available by the curtain wall anchor fire protection apparatus of the present invention an intumescent liner 22 can, preferably be included, which can be formed of an intumescent paper material to facilitate firestopping. The intumescent liner is configured to be placed within the protective chamber 18 of housing 16 prior to securement thereof with respect to the floor underside 12 of the floor 10. Preferably, intumescent liner 22 will include panels or portions thereof extending over the entire interior surfaces of those areas of housing 16 that define the protective chamber means 18. The preferred best mode of housing 16 shown in FIG. 3 will be a construction defining inner walls 30, 32, 34 and 38 and a chamber floor 36 therebelow. With this construction for the protective chamber means 18 defined by housing 16, the preferable construction for the configuration of the intumescent paper liner 22 will include a first liner panel 40 extending over the first inner wall 30 and a second liner panel 42 extending over the second inner wall 32. Similarly, a third liner panel 44 will, preferably, be included extending over the third inner wall 34 and a fourth liner panel 46 will be included extending over the fourth inner wall 38. Intumescent liner 22 will also, preferably, include a floor panel 47 which extends over the chamber floor 36. These five panels of the intumescent paper liner are preferably all attached with respect to one another and are preferably integrally formed with respect to one another with various folds defined in the intumescent paper material to allow panels 40,42,44, 46 and 47 to be positioned extending over and adjacent to walls 30,32,34,38 and 36, respectively. In this manner enhanced fire protection is possible for any curtain wall anchor which is positioned within the protective chamber means 18 of this construction due to the combination of fire protection properties provided by the mineral wool material of the housing 16 and the intumescent properties of the intumescent liner 22.

Securement of the intumescent liner 22 in proper position within the protective chamber means 18 is enhanced by the inclusion of an intumescent liner flange 23. The intumescent liner flange 23 provides a portion of the intumescent paper liner which can be attached with respect to the floor underside 12 of the floor 10 and, preferably, is positionable between the housing flange 17 and the floor underside 12 in such a manner that the attachment of the housing flange 17 with respect to the floor underside 12 will result in simultaneous securement of the intumescent paper liner 22 with respect to the underside 12 of floor 10. This securement is normally achieved by the use of threaded or similar fasteners 48 such as screws which would be driven upwardly through the housing flange 17 and through the intumescent liner flange 23 and into the underside 12 of floor 10. Thus, housing 16 and intumescent liner 22 could easily and quickly be attached with respect to the underside 12 of floor 10.

Figure 5:
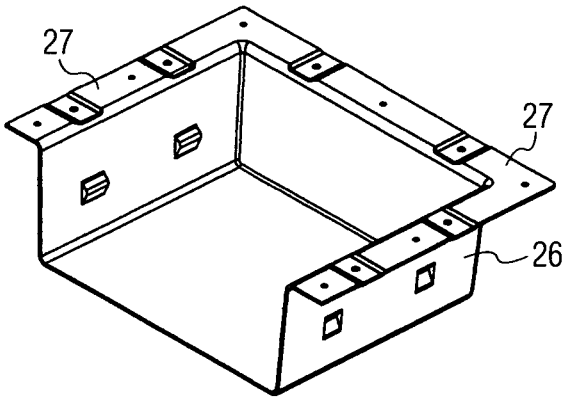
FIG. 5 is a top plan view of an embodiment of an outer cover of the present invention.

It is very important to maintain securement and positioning of the housing 16 and the intumescent liner 22 with respect to the curtain wall anchors extending below the floor underside 12. For this purpose a backing frame member 24 is preferably included in the construction of the present invention. The backing frame member 24 will preferably be of an open wire configuration which is, generally, in the shape of a basket which can easily be positioned surrounding the housing for retaining thereof in proper position responsive to attaching of backing frame member 24 to the underside 12 of floor 10. Backing frame member 24 will extend around and retain the housing 16 thereabove when the open wire backing frame member 24 is secured with respect to the floor underside 12 thereabove. As seen in FIG. 5, the open wire backing frame member 24 is generally basket-shaped such that it can receive and retain the housing 16 thereabove when secured upwardly with respect to the floor underside 12 by fasteners 48 extending therethrough. The open wire configuration of the backing member facilitates solid securement for the construction of the present invention. Backing frame member 24 will, preferably, define a backing frame member flange 25 extending outwardly therefrom. In this manner, fasteners 48 can extend through the backing frame member flange 25 of the open wire backing frame member 24 and then can extend directly through the housing flange and then can extend further upwardly directly through the intumescent liner flange 23 and then be driven further upwardly in order to become embedded in the floor underside 12 of floor construction 10. The added strength provide by inclusion of the open wire backing frame member 24 provides enhance structural stability needed to maintain positioning of housing 16 and intumescent paper liner 22 in proper position such that protection chamber means 18 is maintained in the proper position surrounding and fire protecting a curtain wall anchor or bracket 14 positioned therewithin.

An outer cover 26 can be included an optional component of the present invention and is included primarily for aesthetic purposes and is, preferably, formed of molded plastic. Outer cover 26 preferably includes an outer cover flange 27 extending outwardly therefrom. When the outer cover 26 is used it is preferably formed of a molded plastic configuration and is somewhat decorative. The main purpose of outer cover 26 is to prevent viewing of the structural components of the fire protection apparatus of the present invention, particularly, restricting view from below of the open wire backing frame member 24, and the housing 16 and any other portions retained thereabove such as installation hardware like fasteners 48.

Installation of the entire apparatus of the present invention is enhanced by the use of fasteners 48 extending upwardly initially through the outer cover flange 27 and then through the housing flange 17 and finally through the intumescent liner flange 22 and further upwardly to be embedded within the floor underside 12 of floor 10. This present construction provides a simple and speedy simultaneous installation procedure for installing all components of the fire protection apparatus disclosed herein made possible by driving one or more fasteners 48 upwardly through the readily accessible and adjacently positioned flanges 27, 23 and 17 of each component of the present apparatus and finally driving fasteners 48 into the underside 12 of floor 10.

Figure 6:
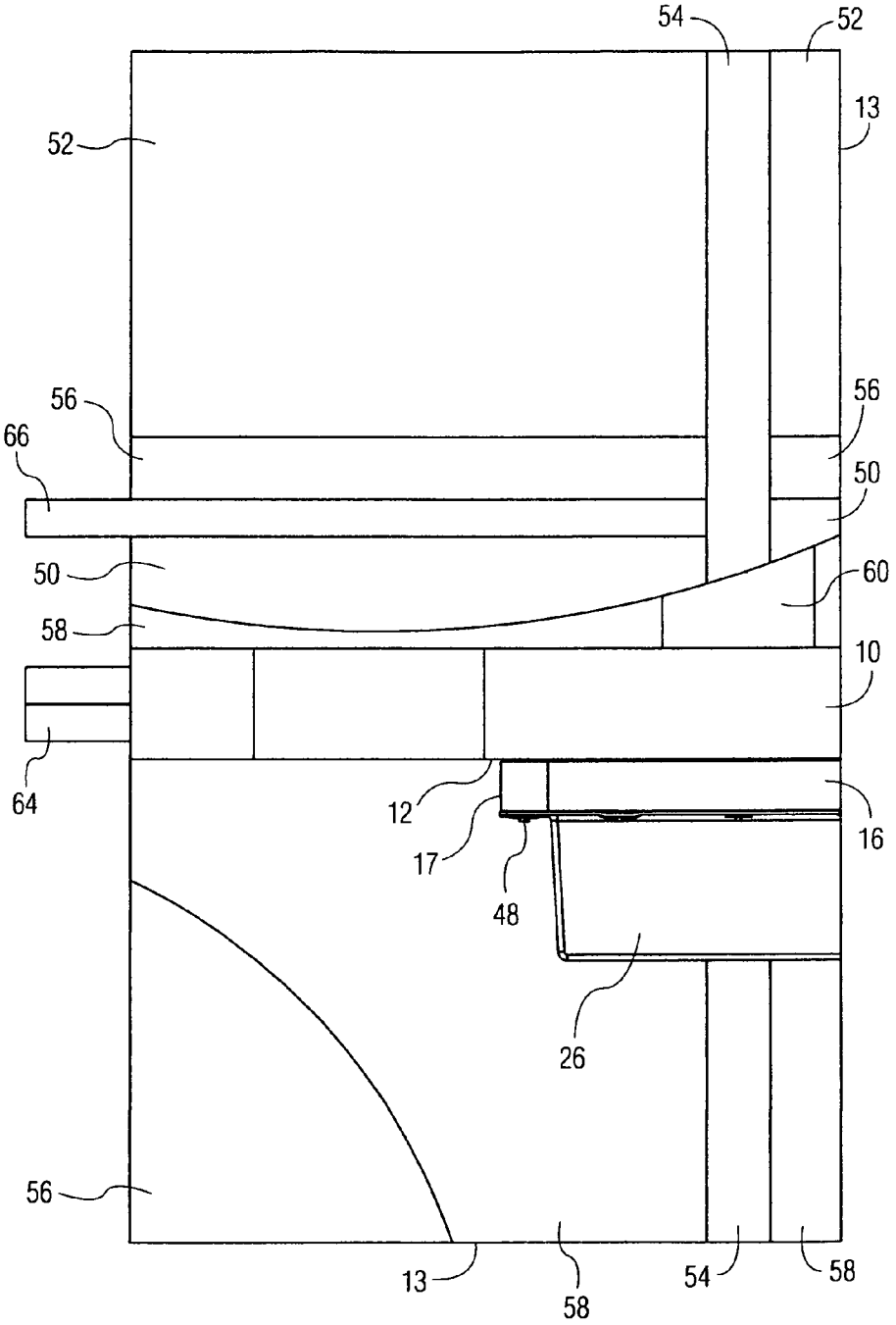
FIG. 6 is a front plan view of an embodiment of the curtain wall anchor fire protection apparatus of the present invention shown in position secured to the underside of a conventional concrete floor and also showing substantial portions of the surrounding curtain wall construction as secured therearound.

The importance of the construction of the present invention in providing fire protection to the curtain wall anchors and brackets positioned extending down from floor undersides 12 is best appreciated when considering the vast expanses and structural portions of the exterior cladding and exterior wall construction of a building which is supported by curtain wall anchors 14. FIGS. 1 and 6 illustrate the apparatus of the present invention held in position with the fasteners 48 firmly engaged to retain the various components of the curtain wall anchor fire protection apparatus in firm engagement with the floor underside 12 thereabove in order to maintain proper positioning extending around a curtain wall anchor or bracket 14 positioned within the protective chamber means 18. The various portions of the curtain wall 13 which are supported by the dead-load curtain wall anchors 14 are particularly shown in FIGS. 1 and 6 which illustrate spandrel panels 50, glass 52, vertical mullions 54 and transoms 56. Also illustrated in these two figures are mullion covers 60, stiffener tees 64, perimeter angles 66 and the curtain wall insulation 58 and the safing 62. The vast expanse of this construction is shown in FIGS. 1 and 6 and, as such, the importance of enhancing the fire protective capabilities of the apparatus of the present invention is clearly evident.

With this construction, the present invention provides a unique means for protecting of the curtain wall spandrel dead-load anchors 14 mounted to the undersides 12 of floors 10 such as concrete floors by isolating and protecting them from exposure to direct fire and/or heat conditions.

While particular embodiments of this invention has been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A curtain wall anchor fire protection apparatus for protecting a curtain wall anchor which is attached to the underside of a floor construction in a position extending therebelow, said curtain wall anchor fire protection apparatus comprising a housing of fire protective material of molded mineral wool which defines a protective chamber means therewithin, said housing also defining an upper opening therein in full fluid flow communication with respect to said protective chamber means, said housing being attachable to the underside of a floor construction with the curtain wall anchor extending downwardly through said upper opening into said protective chamber means therebelow to surround the curtain wall anchor for fire protection thereof, said apparatus further comprising an intumescent liner of intumescent paper positioned within said protective chamber means for positioning thereof between said housing and the curtain wall anchor positioned within said protective chamber means thereof for enhancing fire protection thereof, said intumescent liner being positioned extending over said housing in the area thereof within said protective chamber means, said apparatus further comprising a backing frame member attachable with respect to the underside of the floor construction and extending around said housing for facilitating retaining thereof in position extending around the curtain wall anchor, said apparatus further comprising an outer cover attachable with respect to the underside of the floor construction extending around said backing frame member.

2. A curtain wall anchor fire protection apparatus for protecting a curtain wall anchor which is attached to the underside of a floor construction in a position extending therebelow as defined in claim 1 wherein said backing frame member comprises an open wire backing frame member.

3. A curtain wall anchor fire protection apparatus for protecting a curtain wall anchor which is attached to the underside of a floor construction in a position extending therebelow as defined in claim 1 wherein said outer cover comprises a molded plastic outer cover.

4. A curtain wall anchor fire protection apparatus for protecting a curtain wall anchor which is attached to the underside of a floor construction in a position extending therebelow as defined in claim 1 wherein said housing includes a housing flange extending outwardly therefrom along the floor undersurface to facilitate attachment of said housing with respect to the underside of a floor construction by attaching said housing flange with respect thereto.

5. A curtain wall anchor fire protection apparatus for protecting a curtain wall anchor which is attached to the underside of a floor construction in a position extending therebelow as defined in claim 4 wherein said housing flange defines at least one housing flange securement aperture extending therethrough to facilitate securement of said housing with respect to the underside of a floor.

6. A curtain wall anchor fire protection apparatus for protecting a curtain wall anchor which is attached to the underside of a floor construction in a position extending therebelow as defined in claim 1 wherein said housing includes a housing flange extending outwardly therefrom to facilitate attachment of said housing with respect to the floor undersurface, and wherein said intumescent liner includes an intumescent liner flange extending outwardly to a position between said housing flange and the underside of the floor construction to be simultaneously attachable with respect to the floor undersurface responsive to attachment of said housing flange with respect to the floor undersurface.

7. A curtain wall anchor fire protection apparatus for protecting a curtain wall anchor which is attached to the underside of a floor construction in a position extending therebelow as defined in claim 1 wherein said backing frame member includes a backing frame member flange extending outwardly therefrom to facilitate attachment of said housing with respect to the underside of a floor.

8. A curtain wall anchor fire protection apparatus for protecting a curtain wall anchor which is attached to the underside of a floor construction in a position extending therebelow as defined in claim 1 wherein said outer cover includes a outer cover flange extending outwardly therefrom to facilitate attachment of said outer cover with respect to the underside of a floor.

9. A curtain wall anchor fire protection apparatus for protecting a curtain wall anchor which is attached to the underside of a floor construction in a position extending therebelow as defined in claim 1 wherein said housing defines a first inner wall therewithin and a second inner wall therewithin spatially disposed from said first inner wall and extending parallel with respect thereto, said housing further defining a third inner wall extending between said first inner wall and said second inner wall and being perpendicularly oriented with respect thereto, said housing further defining a fourth inner wall extending between said first inner wall and said second inner wall and being perpendicularly oriented with respect thereto, said fourth inner wall being spatially disposed from said third inner wall, wherein said first inner wall, said second inner wall, said third inner wall and said four inner wall together define said protective chamber means therebetween, said housing further defining a chamber floor perpendicularly oriented with respect to said first inner wall, said second inner wall, said third inner wall and said fourth inner wall and spatially disposed from said upper opening to facilitate defining of said protective chamber means thereadjacent.

10. A curtain wall anchor fire protection apparatus for protecting a curtain wall anchor which is attached to the underside of a floor construction in a position extending therebelow as defined in claim 9 wherein said intumescent liner includes:

A. a first liner panel positionable extending over and in abutment with said first inner wall to facilitate firestopping within said protective chamber means to facilitate firestopping within said protective chamber means adjacent the curtain wall anchor;

B. a second liner panel positionable extending over and in abutment with said second inner wall to facilitate firestopping within said protective chamber means adjacent the curtain wall anchor;

C. a third liner panel positionable extending over and in abutment with said third inner wall to facilitate firestopping within said protective chamber means adjacent the curtain wall anchor;

D. a fourth liner panel positionable extending over and in abutment with said fourth inner wall to facilitate firestopping within said protective chamber means adjacent the curtain wall anchor; and E. a floor liner panel positionable extending over and in abutment with said chamber floor to facilitate firestopping within said protective chamber means adjacent the curtain wall anchor.

11. A curtain wall anchor fire protection apparatus for protecting a curtain wall anchor which is attached to the underside of a floor construction in a position extending therebelow as defined in claim 1 wherein said protective chamber means has a rectangular cross-section.

12. A curtain wall anchor fire protection apparatus for protecting a curtain wall anchor which is attached to the underside of a floor construction in a position extending therebelow as defined in claim 4 wherein the underside of the floor construction extends completely across said upper opening for closing and firestop sealing thereof to facilitate fire protection of the curtain wall anchor located extending into said protective chamber means responsive to attachment of said housing flange with respect to the underside of the floor construction.

13. A curtain wall anchor fire protection apparatus for protecting a curtain wall anchor which is attached to the underside of a floor construction in a position extending therebelow, said curtain wall anchor fire protection apparatus comprising a housing of fire protective material which defines a protective chamber means therewithin, said housing also defining an upper opening therein in full fluid flow communication with respect to said protective chamber means, said housing being attachable to the underside of a floor construction with the curtain wall anchor extending downwardly through said upper opening into said protective chamber means therebelow to surround the curtain wall anchor for fire protection thereof, said apparatus further including an intumescent liner positioned within said protective chamber means for positioning thereof between said housing and the curtain wall anchor positioned within said protective chamber means thereof for enhancing fire protection thereof, said apparatus further including a backing frame member comprising an open wire backing frame member attachable with respect to the underside of the floor construction and extending around said housing for facilitating retaining thereof in position extending around the curtain wall anchor.

14. A curtain wall anchor fire protection apparatus for protecting a curtain wall anchor which is attached to the underside of a floor construction in a position extending therebelow as defined in claim 13 further comprising an outer cover attachable with respect to the underside of the floor construction extending around said backing frame member.

15. A curtain wall anchor fire protection apparatus for protecting a curtain wall anchor which is attached to the underside of a floor construction in a position extending therebelow as defined in claim 13 wherein said housing is formed of molded mineral wool material.

16. A curtain wall anchor fire protection apparatus for protecting a curtain wall anchor which is attached to the underside of a floor construction in a position extending therebelow as defined in claim 13 wherein said intumescent liner comprises an intumescent paper liner.

17. A curtain wall anchor fire protection apparatus for protecting a curtain wall anchor which is attached to the underside of a floor construction in a position extending therebelow as defined in claim 13 wherein said intumescent liner is positioned extending over said housing in the area thereof within said protective chamber means.

18. A curtain wall anchor fire protection apparatus for protecting a curtain wall anchor which is attached to the underside of a floor construction in a position extending therebelow as defined in claim 14 wherein said outer cover comprises a molded plastic outer cover.

19. A curtain wall anchor fire protection apparatus for protecting a curtain wall anchor which is attached to the underside of a floor construction in a position extending therebelow as defined in claim 13 wherein said housing includes a housing flange extending outwardly therefrom along the floor undersurface to facilitate attachment of said housing with respect to the underside of a floor construction by attaching said housing flange with respect thereto.

20. A curtain wall anchor fire protection apparatus for protecting a curtain wall anchor which is attached to the underside of a floor construction in a position extending therebelow as defined in claim 19 wherein said housing flange defines at least one housing flange securement aperture extending therethrough to facilitate securement of said housing with respect to the underside of a floor.

21. A curtain wall anchor fire protection apparatus for protecting a curtain wall anchor which is attached to the underside of a floor construction in a position extending therebelow as defined in claim 13 wherein said housing includes a housing flange extending outwardly therefrom to facilitate attachment of said housing with respect to the floor undersurface, and wherein said intumescent liner includes an intumescent liner flange extending outwardly to a position between said housing flange and the underside of the floor construction to be simultaneously attachable with respect to the floor undersurface responsive to attachment of said housing flange with respect to the floor undersurface.

22. A curtain wall anchor fire protection apparatus for protecting a curtain wall anchor which is attached to the underside of a floor construction in a position extending therebelow as defined in claim 13 wherein said backing frame member includes a backing frame member flange extending outwardly therefrom to facilitate attachment of said housing with respect to the underside of a floor.

23. A curtain wall anchor fire protection apparatus for protecting a curtain wall anchor which is attached to the underside of a floor construction in a position extending therebelow as defined in claim 14 wherein said outer cover includes a outer cover flange extending outwardly therefrom to facilitate attachment of said outer cover with respect to the underside of a floor.

24. A curtain wall anchor fire protection apparatus for protecting a curtain wall anchor which is attached to the underside of a floor construction in a position extending therebelow as defined in claim 13 wherein said housing defines a first inner wall therewithin and a second inner wall therewithin spatially disposed from said first inner wall and extending parallel with respect thereto, said housing further defining a third inner wall extending between said first inner wall and said second inner wall and being perpendicularly oriented with respect thereto, said housing further defining a fourth inner wall extending between said first inner wall and said second inner wall and being perpendicularly oriented with respect thereto, said fourth inner wall being spatially disposed from said third inner wall, wherein said first inner wall, said second inner wall, said third inner wall and said four inner wall together define said protective chamber means therebetween, said housing further defining a chamber floor perpendicularly oriented with respect to said first inner wall, said second inner wall, said third inner wall and said fourth inner wall and spatially disposed from said upper opening to facilitate defining of said protective chamber means thereadjacent.

25. A curtain wall anchor fire protection apparatus for protecting a curtain wall anchor which is attached to the underside of a floor construction in a position extending therebelow as defined in claim 24 wherein said intumescent liner includes:

A. a first liner panel positionable extending over and in abutment with said first inner wall to facilitate firestopping within said protective chamber means to facilitate firestopping within said protective chamber means adjacent the curtain wall anchor;

B. a second liner panel positionable extending over and in abutment with said second inner wall to facilitate firestopping within said protective chamber means adjacent the curtain wall anchor;

C. a third liner panel positionable extending over and in abutment with said third inner wall to facilitate firestopping within said protective chamber means adjacent the curtain wall anchor;

D. a fourth liner panel positionable extending over and in abutment with said fourth inner wall to facilitate firestopping within said protective chamber means adjacent the curtain wall anchor; and E. a floor liner panel positionable extending over and in abutment with said chamber floor to facilitate firestopping within said protective chamber means adjacent the curtain wall anchor.

26. A curtain wall anchor fire protection apparatus for protecting a curtain wall anchor which is attached to the underside of a floor construction in a position extending therebelow as defined in claim 13 wherein said protective chamber means has a rectangular cross-section.

* * * * *